US006196340B1

(12) United States Patent
Jensen et al.

(10) Patent No.: US 6,196,340 B1
(45) Date of Patent: Mar. 6, 2001

(54) SURFACE GEOMETRY FOR NON-PLANAR DRILL INSERTS

(75) Inventors: Kenneth M. Jensen, Orem; Randy S. Cannon, Provo; Troy J. Medford, Orem, all of UT (US)

(73) Assignee: U.S. Synthetic Corporation, Orem, UT (US)

( * ) Notice: Subject to any disclaimer, the term of this patent is extended or adjusted under 35 U.S.C. 154(b) by 0 days.

(21) Appl. No.: 08/980,389

(22) Filed: Nov. 28, 1997

(51) Int. Cl.[7] ..... E21B 10/56
(52) U.S. Cl. ..... 175/431
(58) Field of Search ..... 175/378, 374, 175/375, 426, 431

(56) References Cited

U.S. PATENT DOCUMENTS

| | | | |
|---|---|---|---|
| 4,109,737 | 8/1978 | Bovenkerk | 175/329 |
| 4,604,106 | 8/1986 | Hall et al. | 51/293 |
| 4,694,918 | 9/1987 | Hall | 175/329 |
| 4,858,707 | 8/1989 | Jones et al. | 175/329 |
| 4,997,049 | 3/1991 | Tank et al. | 175/410 |
| 5,154,245 | 10/1992 | Waldenstrom et al. | 175/430.2 |
| 5,217,081 | 6/1993 | Waldenstrom et al. | 175/420.2 |
| 5,264,283 | 11/1993 | Waldenstrom et al. | 428/408 |
| 5,304,342 | 4/1994 | Hall et al. | 419/11 |
| 5,335,738 | 8/1994 | Waldenstrom et al. | 175/420.2 |
| 5,370,195 | 12/1994 | Keshavan et al. | 175/420.2 |
| 5,379,854 | 1/1995 | Dennis | 175/434 |
| 5,447,208 | 9/1995 | Lund et al. | 175/428 |
| 5,544,713 | 8/1996 | Dennis | 175/434 |
| 5,606,198 * | 2/1997 | Tibbitts et al. | 175/432 |
| 5,624,068 | 4/1997 | Waldenstrom et al. | 228/262.21 |
| 5,653,300 | 8/1997 | Lund et al. | 175/428 |
| 5,839,526 * | 11/1998 | Cisneros et al. | 175/431 |

* cited by examiner

*Primary Examiner*—Frank Tsay
(74) *Attorney, Agent, or Firm*—Lloyd W. Sadler

(57) ABSTRACT

A cutting element insert is provided for use with drills used in the drilling and boring through of subterranean formations. This new insert has a modified diamond surface shape having ridges, facets and/or other discontinuities on the cutting surface topography, formed on or about an otherwise non-planar shape, such as spherical, hemispherical, conical or the like. This modified diamond layer shape provides increased cutting stress at the diamond/rock interface, thereby causing the rock to fail with less over all drilling energy being required, while simultaneously introducing little additional stresses to the cutter or insert.

3 Claims, 7 Drawing Sheets

SURFACE GEOMETRY FOR NON-PLANAR DRILL INSERTS

BACKGROUND OF THE INVENTION

1. Field of the Invention

This invention relates to devices for drilling and boring through subterranean formations. More specifically, this invention relates to polycrystalline diamond compacts ("PDCs"), also known as cutting elements or diamond inserts, which are intended to be installed as the cutting element of a drill bit which is used for boring through rock in many applications, including such as oil, gas, mining, and/or geothermal exploration, requiring drilling through geological formations. Still more specifically, this invention relates to polycrystalline diamond inserts which have a surface topography formed integral to an otherwise spherical, conical, or other uniform geometric shape, to increase stress at the insert/rock interface, thereby inducing the rock to fail with the expenditure of less overall energy while introducing little additional internal stress to the insert.

2. Description of Related Art

Three types of drill bits are most commonly used in penetrating geologic formations. These are: (1) percussion bits; (2) rolling cone bits, also referred to as rock bits; and (3) drag bits, or fixed cutter rotary bits. Each of these types of bits may employ polycrystalline diamond inserts as the primary cutting device.

In addition to the drill bits discussed above, polycrystalline diamond inserts may also be used with other down hole tools, including but not limited to: reamers, stabilizers, and tool joints. Similar devices used in the mining industry may also use this invention.

Percussion bits penetrate through subterranean geologic formations by an extremely rapid series of impacts. The impacts may be combined with simultaneous rotations of the bit. An exemplary percussion bit is shown in FIG. 1*b*. The reader is directed to the following list of related art patents for further discussion of percussion bits.

Rolling cone bits currently make up the largest number of bits used in drilling geologic formations. Rolling cone bits have as their primary advantage the ability to penetrate hard geologic formations while generally being available at a relatively low cost. Typically, rolling cone bits operate by rotating three cones, each oriented substantially transverse to the bits axis and in a triangular arrangement, with the narrow end of each cone facing a point in the direct center of the bit. An exemplary rolling cone bit is shown in FIG. 1*a*.

A rolling cone bit cuts through rock by the crushing and scraping action of the abrasive inserts embedded in the surface of the rotating cone. These abrasive inserts are generally composed of cemented tungsten carbide, but may also include the polycrystalline diamond coated cemented tungsten carbide insert of this invention, where increased wear performance is required.

The primary application of this PDC invention is currently believed to be in connection with percussion and rolling cone bits, although alternative embodiments of this invention may find application in connection with other drilling tools.

A third type of bit is the drag bit, also known also as the fixed cutter bit. An example of a drag bit is shown in FIG. 2. The drag bit is designed to be rotated about its longitudinal axis. Most drag bits employ PDCs which are brazed into the cutting blade of the bit. The PDCs then shear the rock as the bit is rotated about its longitudinal axis.

It is expected that this invention will find its primary application in percussion and rolling cone bits, although some use in drag bits is also feasible.

A polycrystalline diamond compact ("PDC"), or cutting element, typically is fabricated by placing a cemented tungsten carbide substrate into a refactory metal container ("can") with a layer of diamond crystal powder placed into the can adjacent to one face of the substrate. The can is then covered. A number of such can assemblies are loaded into a high pressure cell made from a soft ductile solid material such as pyrophyllite or talc. The loaded high pressure cell is then placed in an ultra-high pressure press. The entire assembly is compressed under ultra-high pressure and ultra-high temperature conditions. Compression causes the metal binder from the cemented carbide substrate to become liquid and to "sweep" from the substrate face through the diamond grains and to act as a reactive liquid phase thereby promoting the sintering of the diamond grains. Sintering of the diamond grains causes the formation of a polycrystalline diamond structure. As a result the diamond grains become mutually bonded to form a diamond mass over the substrate face. The metal binder may remain in the diamond layer within the pores of the polycrystalline structure or, alternatively, it may be removed via acid leeching and optionally replaced by another material forming so-called thermally stable diamond ("TSD"). Variations of this general process exist and are described in the related art. This detail is provided so the reader may become familiar with the concept of sinteling a diamond layer onto a substrate to form a PDC insert. For more information concerning this process, the reader is directed to U.S. Pat. No. 3,745,623, issued to Wentorf Jr. et al., on Jul. 7, 1973.

Existing art PDCs exhibit durability problems in cutting through tough geologic formations, where the diamond working surface may experience transient high stress loads. Under such conditions, typical existing PDCs have a tendency to crack, spall, and break. Similarly, existing PDCs are relatively weak when placed under high loads from a variety of angles. These problems of existing PDCs are further exacerbated by the dynamic nature of both normal and torsional loading during the drilling process, during which the bit face moves into and out of contact with the uncut material forming the bottom of the well bore.

The interface between the diamond layer and the tungsten carbide substrate must be capable of sustaining the high residual stresses that arise from the thermal expansion and bulk modulus mismatches between the two materials. These differences tend to create high residual stress at the interface as the materials are cooled from the high temperature and pressure process. Residual stress can be deleterious to the life of the PDC cutting elements, or inserts, during drilling operations. Because high tensile stresses in the substrate or diamond layer may cause fracture, spalling, or complete delamination of the diamond layer from the substrate.

Diamond is used as a drilling material primarily because of its extreme hardness and abrasion resistance. However, diamond also has a major drawback. Diamond, as a cutting material, has very poor toughness, that is, it is very brittle. For this reason, anything that contributes to further reducing the toughness of the diamond, substantially degrades its durability.

A number of other approaches and applications of PDCs are well established in related art. The applicant includes the following references to related art patents for the reader's general familiarization with this technology.

U.S. Pat. No. 4,109,737 describes a rotary drill bit for rock drilling comprising a plurality of cutting elements mounted by interference-fit in recesses in the crown of the drill bit.

U.S. Pat. No. 4,604,106 reveals a composite polycrystalline diamond compact comprising at least one layer of diamond crystals and precemented carbide pieces which have been pressed under sufficient heat and pressure to create composite polycrystalline material wherein polycrystalline diamond and the precemented carbide pieces are interspersed in one another.

U.S. Pat. No. 4,694,918 describes an insert that has a tungsten carbide body and at least two layers at the protruding drilling portion of the insert. The outermost layer contains polycrystalline diamond and the remaining layers adjacent to the polycrystalline diamond layer are transition layers containing a composite of diamond crystals and precemented tungsten carbide, the composite having a higher diamond crystal content adjacent to the polycrystalline diamond layer and a higher precemented tungsten carbide content adjacent to the tungsten carbide layer.

U.S. Pat. No. 4,858,707 describes a diamond insert for a rotary drag bit consists of an insert stud body that forms a first base end and a second cutter end.

U.S. Pat. No. 4,997,049 describes a tool insert having a cemented carbide substrate with a recess formed in one end of the substrate and having abrasive compacts located in the recesses and bonded to the substrate.

U.S. Pat. No. 5,154,245 relates to a rock bit insert of cemented carbide for percussive or rotary crushing rock drilling. The button insert is provided with one or more bodies of polycrystalline diamond in the surface produced by high pressure and high temperature in the diamond stable area. Each diamond body is completely surrounded by cemented carbide except the top surface.

U.S. Pat. No. 5,217,081 relates to a rock bit insert of cemented carbide provided with one or more bodies or layers of diamond and/or cubic boron nitride produced at high pressure and high temperature in the diamond or cubic boron nitride stable area. The body of cemented carbide has a multi-structure containing eta-phase surrounded by a surface zone of cemented carbide free of eta-phase and having a low content of cobalt in the surface and a higher content of cobalt next to the eta-phase zone.

U.S. Pat. No. 5,264,283 relates to buttons, inserts and bodies that comprise cemented carbide provided with bodies and/or layers of CVD- or PVD-fabricated diamond and then high pressure/high temperature treated in the diamond stable area.

U.S. Pat. No. 5,304,342 describes a sintered product useful for abrasion- and impact-resistant tools and the like, comprising an iron-group metal binder and refractory metal carbide particles.

U.S. Pat. No. 5,335,738 relates to a button of cemented carbide. The button is provided with a layer of diamond produced at high pressure and high temperature in the diamond stable area. The cemented carbide has a multi-phase structure having a core that contains eta-phase surrounded by a surface zone of cemented carbide free of eta-phase.

U.S. Pat. No. 5,370,195 describes a drill bit having a means for connecting the bit to a drill string and a plurality of inserts at the other end for crushing the rock to be drilled, where the inserts have a cemented tungsten carbide body partially embedded in the drill bit and at least two layers at the protruding drilling portion of the insert. The outermost layer contains polycrystalline diamond and particles of carbide or carbonitride.

U.S. Pat. No. 5,379,854 discloses a cutting element which has a metal carbide stud with a plurality of ridges formed in a reduced or full diameter hemispherical outer end portion of said metal carbide stud. The ridges extend outwardly beyond the outer end portion of the metal carbide stud. A layer of polycrystalline material, resistant to corrosive and abrasive materials, is disposed over the ridges and the outer end portion of the metal carbide stud to form a hemispherical cap.

U.S. Pat. No. 5,544,713 discloses a cutting element with a metal carbide stud that has a conic tip formed with a reduced diameter hemispherical outer tip end portion of said metal carbide stud. A corrosive and abrasive resistant polycrystalline material layer is also disposed over the outer end portion of the metal carbide stud to form a cap, and an alternate conic form has a flat tip face. A chisel insert has a transecting edge and opposing flat faces, which chisel insert is also covered with a polycrystalline diamond compact layer.

U.S. Pat. No. 5,624,068 describes buttons, inserts and bodies for rock drilling, rock cutting, metal cutting and wear part applications, where the buttons or inserts or bodies comprise cemented carbide provided with bodies and/or layers of CVD- or PVD- fabricated diamond and then HP/HT treated in a diamond stable area.

Each of the aforementioned patents and elements of related art is hereby incorporated by referenced in its entirety for the material disclosed therein.

SUMMARY OF THE INVENTION

It is desirable to provide an insert, for use in drill bits which are used to bore through subterranean geologic formations, which improves the efficiency of the drilling process by causing the rock formation to fail with less drill energy being required. Furthermore, it is desirable to improve the cutting and crushing efficiency of the drill insert while inducing as little additional stress to the insert or cutting element as possible. This invention provides this increased cutting efficiency while introducing little additional stress to the insert by using a diamond insert surface having a distinct geometric pattern induced on the top surface of the diamond insert. By employing edges, facets, grooves, and ridges in the diamond surface, additional cutting force is applied to the rock. Since the diamond layer in the present invention is relatively thick, compared to typical inserts in prior use, the insert of this invention remains as or more productive as prior inserts even when the edges, facets, grooves, and/or ridges have been worn away. And, until they are worn away, the edges, facets, grooves and/or ridges provide a significant improvement in cutting efficiency. Moreover, this invention is compatible with any substrate interface geometry (including both smooth and patterned geometries) used as an interface surface between the substrate and the diamond layer.

Therefore, it is an objective of this invention to provide an insert with improved cutting efficiency, that is, an insert that will cause the rock being drilled to fail at lower drill energy.

It is a further objective of this invention to provide an insert surface that provides improved cutting efficiency while not significantly increasing the stress induced on the insert itself.

This and other objectives, features and advantages of this invention, which will be readily apparent to those of ordinary skill in the art, upon review of the following drawings, description, and claims, are achieved by the invention as described in this application.

DETAILED DESCRIPTION OF THE INVENTION

Figure 1A:
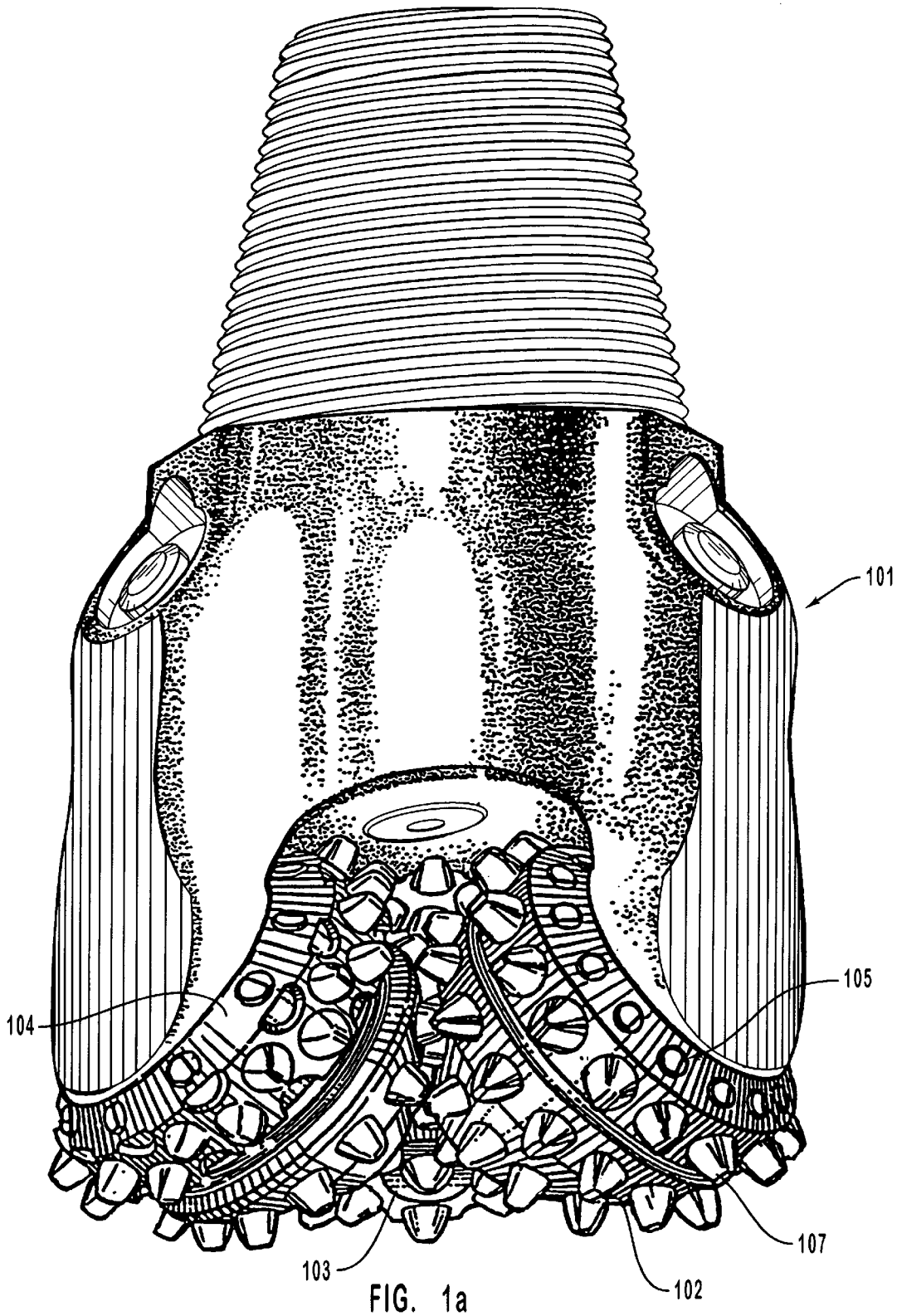
FIG. 1a (Prior Art)
FIG. 1*a* depicts an exemplary related art roller cone earth boring bit.
Figure 1B:
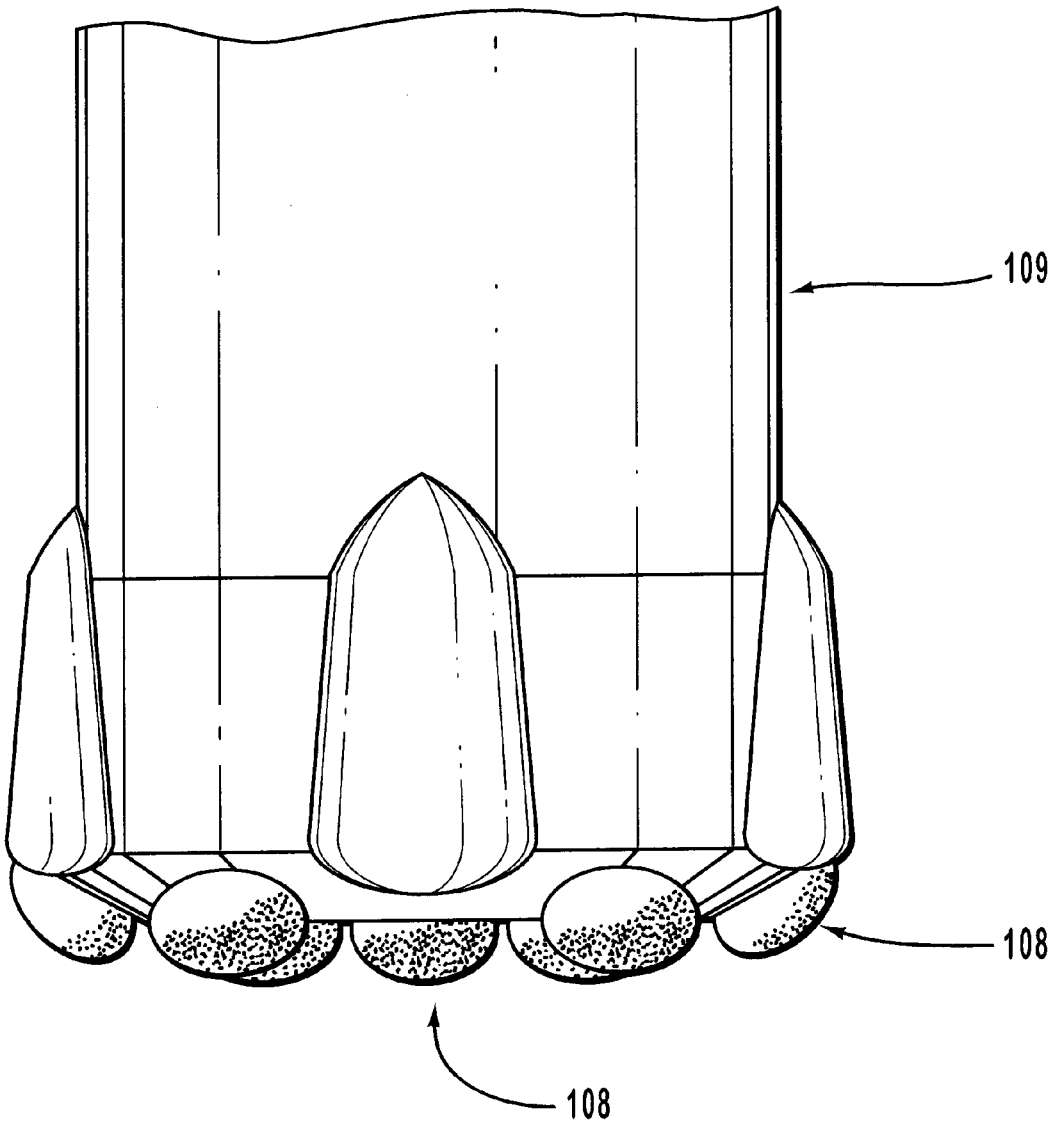
FIG. 1*b* depicts an exemplary related art percussion bit.

This invention is intended for use in drilling or boring tools, most typically roller cone bits as shown in FIG. 1*a* and percussion bits, as shown in FIG. 1*b*. The typical rolling cone bit 101 includes three rotating cones 102, 103, 104. Each rotating cone 102, 103, 104 has a plurality of cutting teeth 107. The polycrystalline diamond inserts of this invention are shown being used as gage cutters 105. Each insert (also known as a drill insert) is pressed into the drill bit such that the diamond surface is exposed outside the bit. Diamond inserts may also be used to extend the life of the cutter teeth 107 as well. FIG. 1*b* shows a standard bit 109 provided with cemented carbide button drill inserts 108 which is used for percussion rock drilling.

Figure 2:
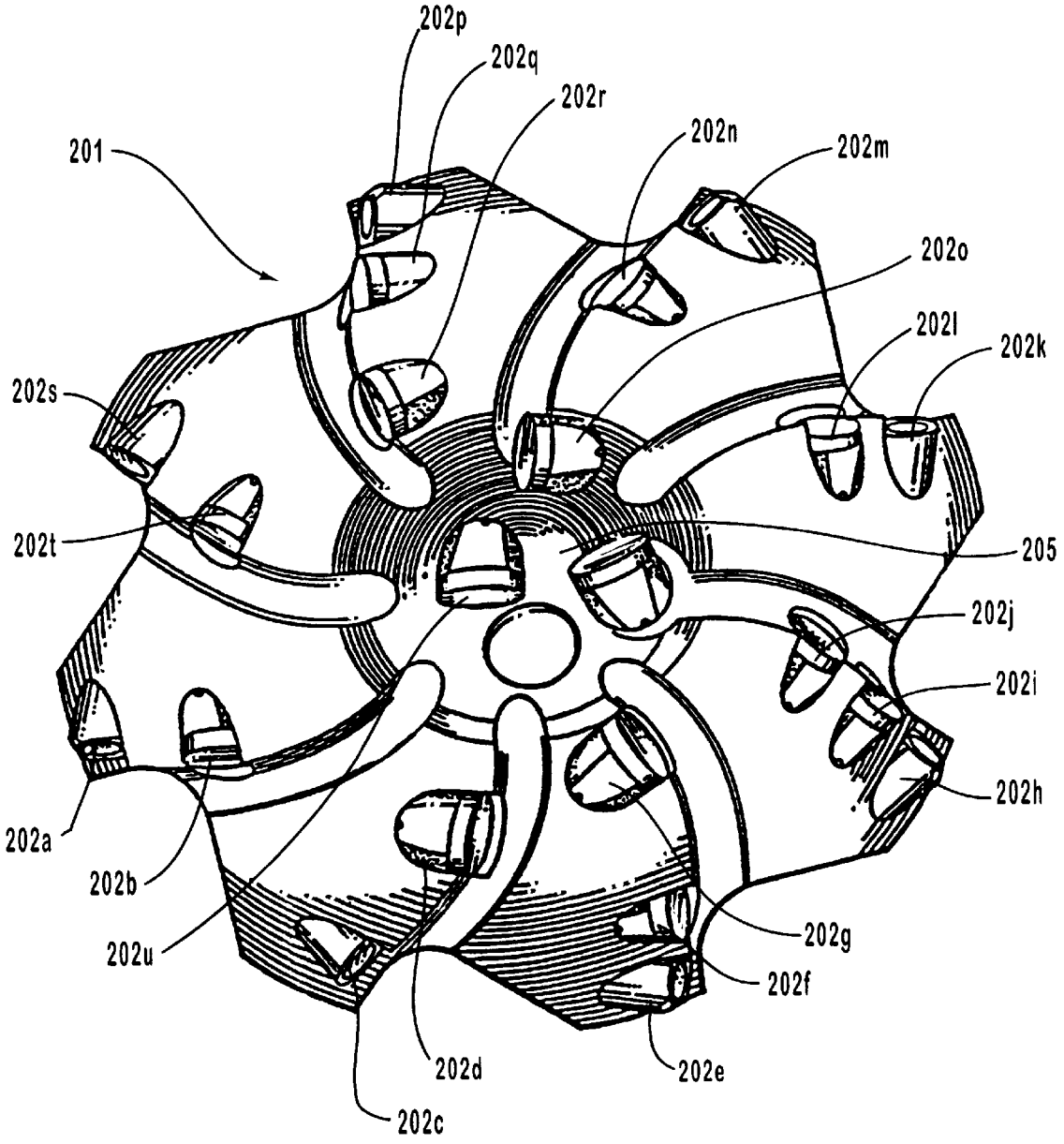
FIG. 2 (Prior Art)
FIG. 2 depicts an exemplary related art drag bit.

FIG. 2 depicts the top view of an example of a typical drag bit 201. A number of inserts, each of which could be an insert of this invention, are shown 202*a–t* arranged in rows emanating in a generally radial fashion from the approximate center 205 of the bit. The inventors expect that the inserts of this invention could be used on rolling cone, percussion and drag bits of virtually any configuration.

In each embodiment of this invention the insert is composed of essentially two materials: polycrystalline diamond, which covers the working surface of the insert; and tungsten carbide. The tungsten carbide region is the portion of the insert that is secured (brazed for drag bits or press fitted for either percussion or roller cone bits) into the bit body, while the polycrystalline diamond region is the area of the insert that comes in contact with the geologic formation during the drilling operation. In the present invention, the polycrystalline diamond region is shaped such that ridges, edges, grooves, and facets of various sizes and shapes are formed on the otherwise spherical, conical or otherwise uniform surface topography of the diamond insert surface. Complex surface topography, which has no uniform geometry as a base, may also be used. In general, prior inserts have a smooth surface topography, typically flat although some non-planar inserts have been suggested. The present invention uses surface discontinuities, ridges, edges, grooves, and facets, to impose increased mechanical stress at the insert/rock interface. The increased mechanical stresses imposed by this invention when the drill is in operation leads to less energy being required to induce the drilled rock to fail. Additionally, minimal additional stress is imposed on the internal structure of the insert. The polycrystalline diamond region of the present invention is generally thicker than typically used in prior inserts. Thicker diamond regions enhance the operational insert life. Alternatively, this invention may be used with a standard or typical thickness of diamond layer. Typical diamond thicknesses are in the range of from 0.020 to 0.040 inches. Even as the surface discontinuities of this invention wear away during drilling, the additional diamond layer thickness of the preferred embodiment provides increased operational life for the insert. As the drill is operated, the diamond region of the insert comes into direct physical contact with hard rock.

The inserts, as described in this invention, although typically constructed with polycrystalline diamond attached to a tungsten carbide substrate, can use other materials, such as cubic boron nitride or some other superabrasive material in place of the polycrystalline diamond. Similarly, titanium carbide, tantalum carbide, vandium carbide, niobium carbide, halfnium carbide, or zirconium carbide can be used in place of tungsten carbide as the substrate material. Such superabrasive materials and substrate materials suitable for use in inserts are well known in the art.

In general, the inserts of this invention are formed by cementing the diamond layer under high temperature and high pressure conditions to the substrate, using a metal binder or reactive liquid phase such as cobalt. The substrate may be brazed or otherwise joined to an attachment member such as a stud or to a cylindrical backing element to enhance its affixation to the bit face or extend its overall length. The cutting element may be mounted to a drill bit either by press-fitting or otherwise locking the stud into a receptacle on a percussion bit, a roller cone bit, or a steel-body drag bit, or by brazing the insert substrate (with or without cylindrical backing) directly into a preformed pocket, socket or other receptacle on the face of a bit body, as on a matrix-type bit.

An insert, as described herein, is preferably fabricated by placing a preformed cemented carbide substrate into a container with a layer of diamond crystals or grains loaded into the container adjacent to one face of the substrate. A number of such containers are then loaded into an ultra-high pressure press. As the press is operated, substrates and adjacent diamond crystal layers are compressed under ultra-high temperature and ultra-high pressure conditions. The ultra-high pressure and ultra-high temperature conditions cause the metal binder from the substrate body to become liquid and to sweep from the region behind the substrate face next to the diamond layer, through the diamond grains and then to act as a reactive liquid phase to promote a sintering of the diamond grains thereby forming the polycrystalline diamond structure. This results in the diamond grains becoming mutually bonded to form a diamond mass which covers the substrate face, and the diamond mass is also bonded to the substrate face. Alternatively, the diamond layer may be formed as above, but separately from the substrate, and may subsequently be bonded to the substrate material by brazing with a tungsten or titanium-based braze. Yet another alternative method is to deposit the diamond layer on the substrate by chemical vapor deposition (CVD) processing. The metal binder may remain in the diamond layer within the pores existing between the diamond grains or may be removed and optionally replaced by another material, as known in the art, to form a so-called thermally stable diamond. If the binder is to be removed, the diamond table is formed with silicon, a material having a coefficient of thermal expansion similar to that of diamond. Variations of this general process exist in the art. This detail is provided so that the reader will understand the concept of sintering a diamond layer onto a substrate in order to form a cutter or insert.

In the case of the present invention, the desired surface shape of the diamond layer may be achieved by lapping, grinding, EDM, EDG, or other similar methods well known in the art. Alternatively, the surface shape can be formed through the use of specially shaped cans or containers as described above as the best mode of the invention.

Ten examples of the inventive insert design of this invention are now described. Further modifications may be made without departing from the essential nature of the invention and such modifications are considered to fall within the scope of this patent.

Figure 3A:
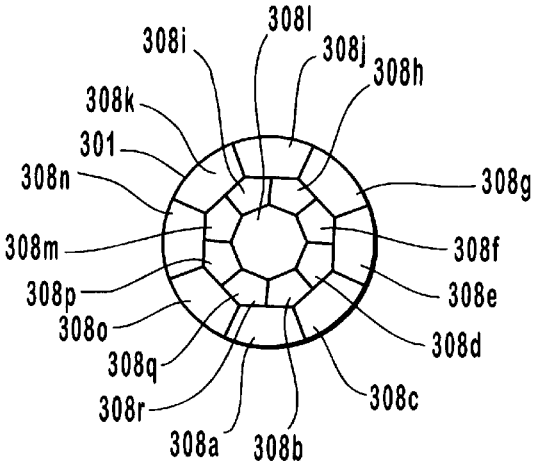
FIG. 3 depicts a first preferred embodiment of the invention having a plurality of facits on the upper surface of the diamond layer of the insert.
Figure 3B:
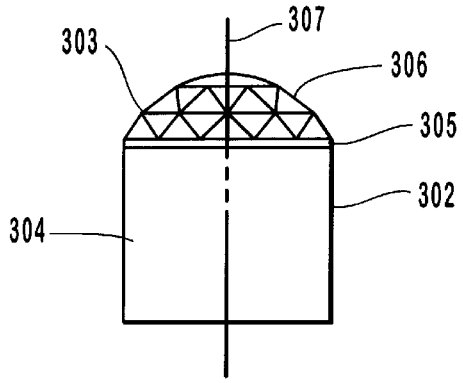

FIG. 3 depicts the top 301 and side 302 view of a single preferred embodiment of the invention. It can be seen that the inserts of this invention are generally cylindrical in shape, with a generally hemispherical diamond surface 306, the apex of the surface is at the center axis 307 of the insert. This diamond insert is composed of a layer of polycrystalline diamond 303 bonded to a tungsten carbide substrate 304. The polycrystalline diamond layer 303 serves as the cutting surface. The surface of the polycrystalline diamond layer is modified from a smooth hemisphere by the introduction of a number of facets 308*a–r*. Each facet 308 is surrounded by a plurality of edges. When the insert is in use the rough surface caused by the edges and the facets serves to impose additional cutting stress on the rock, thereby causing the rock to fail at lower expended drilling energy levels. The interface region 305 is shown where the polycrystalline diamond layer 303 is joined to the substrate 304. In this embodiment of the invention the interface region 305 is essentially flat.

Figure 4A:
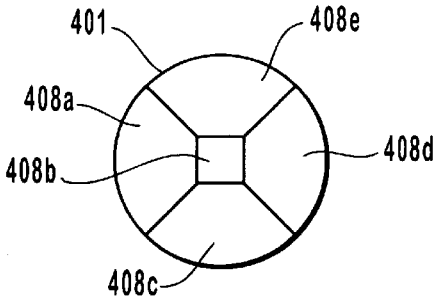
FIG. 4 depicts a second preferred embodiment of the invention having a plurality of facets on the upper surface of the diamond layer of the insert.
Figure 4B:
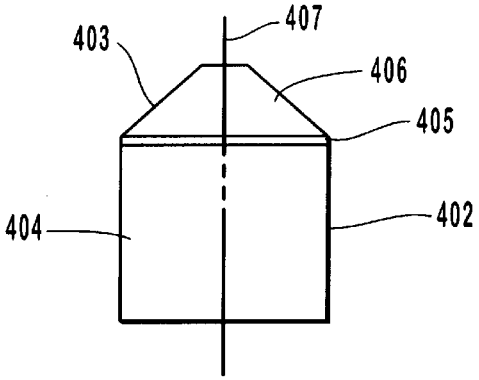

FIG. 4 depicts the top 401 and side 402 view of a second preferred embodiment of the invention, which has somewhat fewer facets and edges. It can be seen that the inserts of this invention are generally cylindrical in shape, with a generally conical diamond surface 406, the apex of which is at the center axis 407 of the insert. This diamond insert is composed of a layer of polycrystalline diamond 403 bonded to a tungsten carbide substrate 404. The polycrystalline diamond layer 403 serves as the cutting surface. The surface of the polycrystalline diamond layer 403 is modified from a smooth hemisphere by the introduction of a number of facets 408*a–e*. Each facet 408 is surrounded by a plurality of edges. When the insert is in use the rough surface caused by the edges and the facets impose additional cutting stress on the rock, thereby causing the rock to fail at lower expended drilling energy levels. The interface region 405 is also shown. This interface region 405 is the region where the polycrystalline diamond layer 403 is joined to the substrate 404. In this embodiment of the invention the interface region 405 is essentially flat.

Figure 5A:
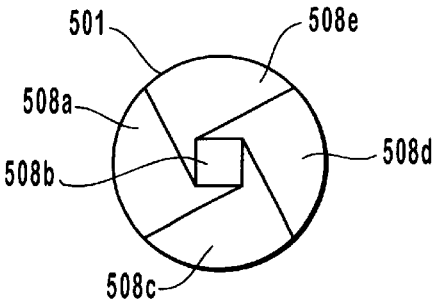
FIG. 5 depicts a third preferred embodiment of the invention having a plurality of facets on the upper surface of the diamond layer of the insert.
Figure 5B:
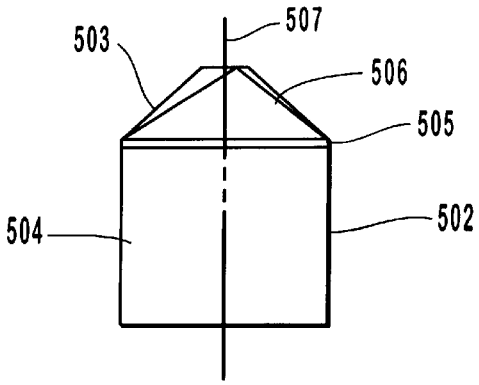

FIG. 5 depicts the top 501 and side 502 view of another preferred embodiment of the invention, having edges which fan out from the center facet. It can be seen that the inserts of this invention are generally cylindrical in shape, with a generally hemispherical diamond surface 506, the apex of the surface of which is at the center axis 507 of the insert. This diamond insert is composed of a layer of polycrystalline diamond 503 bonded to a tungsten carbide substrate 504. The polycrystalline diamond layer 503 serves as the cutting surface. The surface of the polycrystalline diamond layer 503 is modified from a smooth hemisphere by the introduction of a number of facets 508*a–e*. Each facet 508 is surrounded by a plurality of edges. When the insert is in use the rough surface caused by the edges and facets impose additional cutting stress on the rock, thereby causing the rock to fail at lower expended drilling energy levels. The interface region 505 is shown where the polycrystalline diamond layer 503 is joined to the substrate 504. In this embodiment of the invention the interface region 505 may be somewhat flat or may have a more complex interface geometry.

Figure 6A:
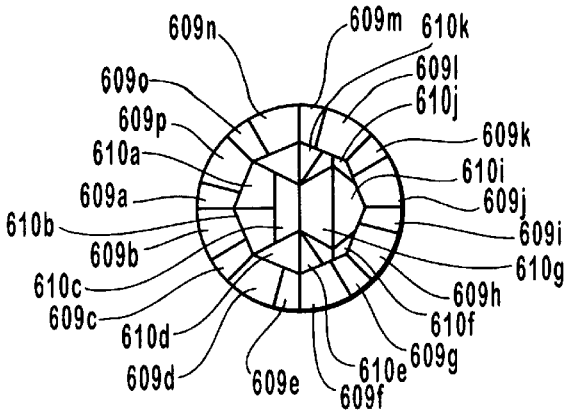
FIG. 6 depicts a fourth preferred embodiment of the invention having a plurality of facets as well as a generally concave shape on the upper surface of the diamond layer of the insert.
Figure 6B:
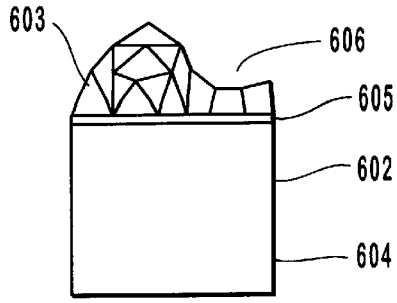

FIG. 6 depicts the top 601 and side 602 view of another embodiment of the invention. Again, the insert is generally cylindrical in shape, with a generally conical diamond surface 606. However, this embodiment of the invention, includes a concavity 608 in the surface of the diamond layer. A number of facets 609*a–p*, 610*a–k* are also provided with surrounding edges to provide a rough surface for increased stress at the insert/rock interface. The diamond insert is composed of a layer of polycrystalline diamond 603 bonded to a tungsten carbide substrate 604. The polycrystalline diamond layer 603 serves as the cutting surface. The interface region 605 is shown where the polycrystalline diamond layer 603 is joined to the substrate 604. In this embodiment of the invention, the interface region 605 may have either a somewhat flat or a more complex interface geometry.

Figure 7A:
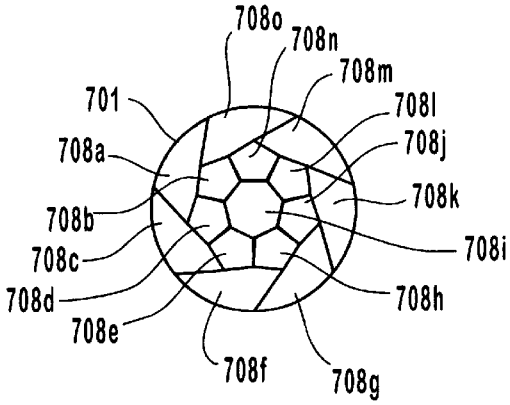
FIG. 7 depicts a fifth preferred embodiment of the invention having a plurality of facets on the upper surface of the diamond layer of the insert.
Figure 7B:
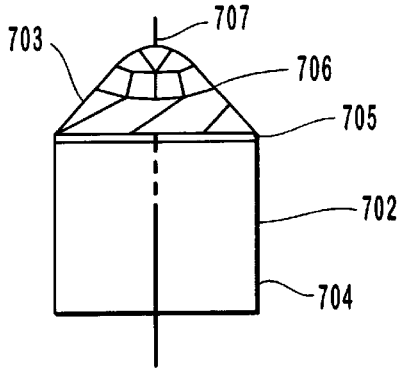

FIG. 7 depicts the top 701 and side 702 view of another embodiment of the invention. Again, the insert is generally cylindrical in shape, with a generally conical diamond surface 706, the apex of which is at the center axis 707 of the insert. A number of facets 708*a–o* are also provided with surrounding edges to provide a rough surface for increased stress at the insert/rock interface. The diamond insert is composed of a layer of polycrystalline diamond 703 bonded to a tungsten carbide substrate 704. The polycrystalline diamond layer 703 serves as the cutting surface. The interface region 705 is shown where the polycrystalline diamond layer 703 is joined to the substrate 704. In this embodiment of the invention the interface region 705 may be either generally flat or, alternatively, may have a more complex interface geometry.

Figure 8A:
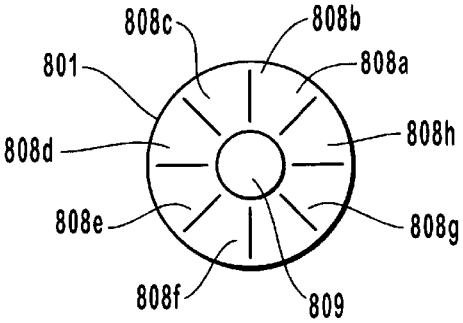
FIG. 8 depicts a sixth preferred embodiment of the invention having a plurality of generally straight grooves on the upper surface of the diamond layer of the insert.
Figure 8B:
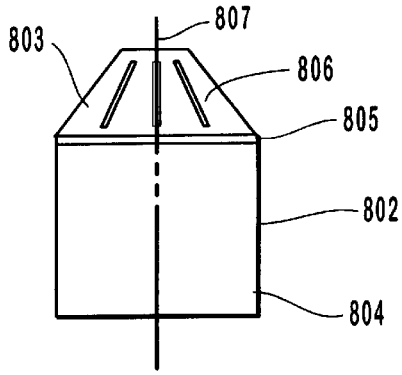

FIG. 8 depicts the top 801 and side 802 view of another embodiment of the invention. Again, the insert is generally cylindrical in shape, although in this embodiment the diamond insert region 803 is shaped as a truncated cone, the apex of which is at the center axis 807 of the insert. A number of grooves 808*a–h* are also provided as is a generally flat surface 809 at the top most surface of the insert. The diamond insert is composed of a layer of polycrystalline diamond 803 bonded to a tungsten carbide substrate 804. The polycrystalline diamond layer 803 serves a the cutting surface. The interface region 805 is shown where the polycrystalline diamond layer 803 is joined to the substrate 804. In this embodiment of the invention the interface region 805 may be either generally flat or, alternatively, may have a more complex interface geometry.

Figure 9A:
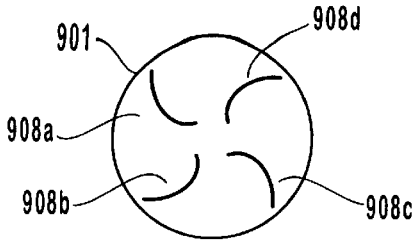
FIG. 9 depicts a seventh preferred embodiment of the invention having a plurality of grooves curving away from the center of the upper surface of the diamond layer of the insert.
Figure 9B:
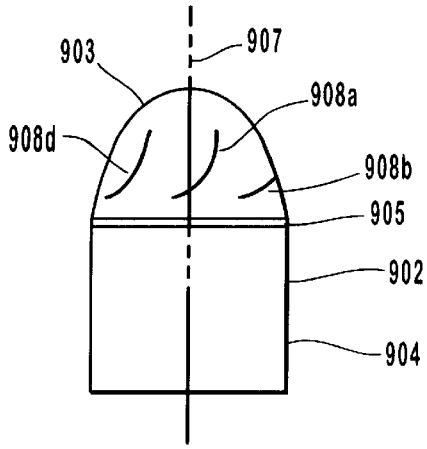

FIG. 9 depicts the top 901 and side 902 view of another embodiment of the invention. Again, the insert is generally cylindrical in shape, with the diamond insert region 903 having a generally hemispheric or oval shape, the apex of which is at the center axis 907 of the insert. A number of grooves 908*a–d* are also provided. The diamond insert is composed of a layer of polycrystalline diamond 903 bonded to a tungsten carbide substrate 904. The polycrystalline diamond layer 903 serves as the cutting surface. The interface region 905, where the polycrystalline diamond layer 903 is joined to the substrate 904, is shown. In this embodiment of the invention the interface region 905 is essentially flat, although, alternatively, a more complex interface region may also be employed.

Figure 10A:
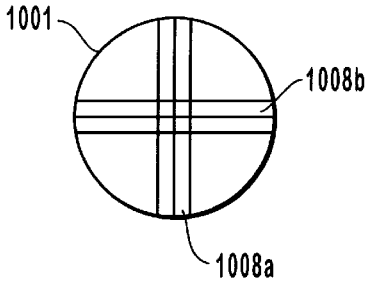
FIG. 10 depicts an eighth preferred embodiment of the invention having a single cross shaped groove in the upper surface of the diamond layer of the insert.
Figure 10B:
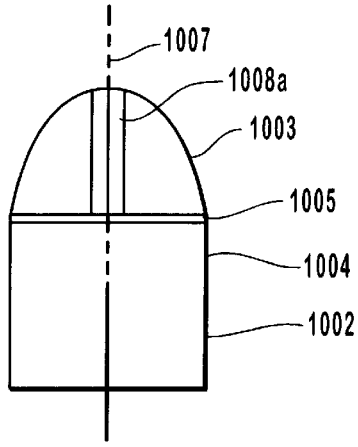

FIG. 10 depicts the top 1001 and side 1002 view of another embodiment of the invention. Again, the insert is generally cylindrical in shape, with the diamond insert region 1003 having a generally hemispheric or oval shape, the apex of which is at the center axis 1007 of the insert. In this embodiment of the invention, two channels 1008*a*, 1008*b* are provided. Each channel originates at the diamond/substrate interface 1005 and passes through the apex of the diamond region through the center axis 1007 of the insert and continues to the opposite side reaching the diamond/substrate interface 1005. The diamond insert is composed of a layer of polycrystalline diamond 1003 bonded to a tungsten carbide substrate 1004. The polycrystalline diamond layer 1003 serves as the cutting surface. The interface region 1005 is shown where the polycrystalline diamond layer 1003 is joined to the substrate 1004. In this embodiment of the invention the interface region is essentially flat, although, alternatively, more complex interface regions could also be used.

Figure 11A:
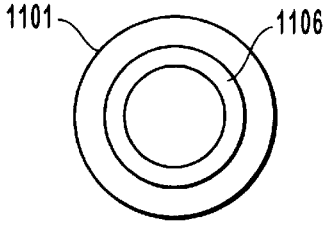
FIG. 11 depicts a ninth preferred embodiment of the invention having a circular ridge in the upper surface of the diamond layer of the insert.
Figure 11B:
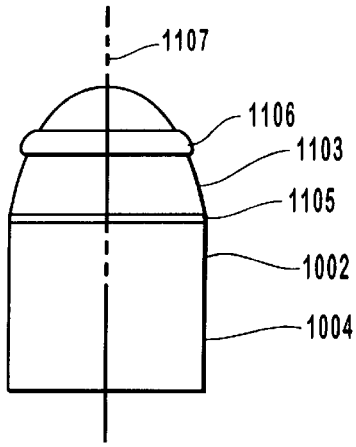

FIG. 11 depicts the top 1101 and side 1102 view of another embodiment of the invention. Again, the insert is generally cylindrical in shape, with the diamond insert region 1103 having a generally hemispheric or oval shape, the apex of which is at the center axis 1107 of the insert. In this embodiment of the invention, a ridge 1106 is provided. This ridge 1106 is composed of polycrystalline diamond and is positioned to circle the diamond region 1103. The diamond insert is composed of a layer of polycrystalline diamond 1103 bonded to a tungsten carbide substrate 1104. The polycrystalline diamond layer 1103 serves as the cutting surface. The interface region 1105 is shown where the polycrystalline diamond layer 1103 is joined to the substrate 1104. In this embodiment of the invention the interface region 1105 is essentially flat, although, alternatively, more complex interface regions may also be employed.

Figure 12A:
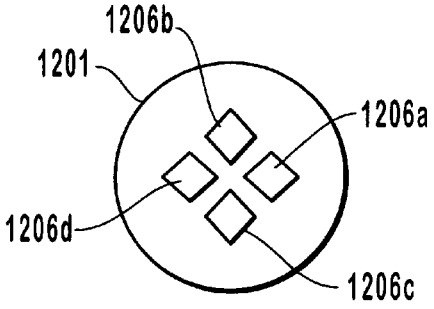
FIG. 12 depicts a tenth preferred embodiment of the invention having a plurality of projections projecting from the upper surface of the diamond layer of the insert.
Figure 12B:
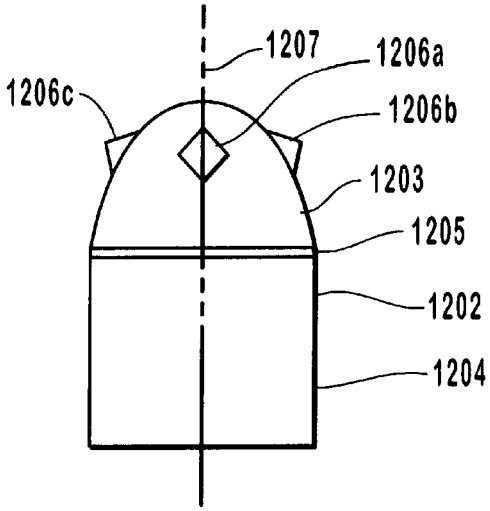

FIG. 12 depicts the top 1201 and side 1202 view of another embodiment of the invention. Again, the insert is generally cylindrical in shape, with the diamond insert region 1203 having a generally hemispherical shape, the apex of which is at the center axis 1207 of the insert. In this embodiment of the invention, a number of projections 1206*a–d* are provided to provide roughness for contact with rock during drilling. The diamond insert is composed of a layer of polycrystalline diamond 1203 bonded to a tungsten carbide substrate 1204. The polycrystalline diamond layer 1203 serves as the cutting surface. The interface region 1205 is shown where the polycrystalline diamond layer 1203 is joined to the substrate 1204. In this embodiment of the invention the interface region is essentially flat, although alternative embodiments of the invention with a more complex interface region are also envisioned.

The described embodiments of this invention are to be considered in all respects only as illustrative of the current best mode of the invention known to the inventors and not as restrictive. Although several of the embodiments shown here include facets, troughs, channels or protrusions in the surface of the diamond region, these topographies are intended to be illustrative only of the currently envisioned best modes of the invention. Alternative topographies, where roughness is introduced in the cutting surface or of the interface region of the insert should be considered within the range and coverage of this invention. Similarly, although a generally flat interface region geometry is shown in these examples, alternative embodiments with roughness, different shapes and/or channels and/or protrusions in the interface could likewise be incorporated in this invention. Additionally, combinations of features of the above described illustrations, including the use of hemispheric, conical or oval surface shapes, of best modes of the invention should also be considered within the scope of this invention. The scope of this invention is, therefore, indicated by the appended claims rather than be the foregoing description. All devices which come within the meaning and range of equivalency of the claims are to be embraced within their scope.

We claim:

1. A drilling insert for use on a bit for drilling subterranean formations, comprising:

(A) a substrate having a top surface; and (B) a layer of superabrasive material, having in interface surface, bonded to said top surface of said substrate, and a cutting surface opposite said interface surface, wherein said cutting surface has a non-planar shape and has one or more discontinuity to increase cutting stress on the subterranean formations during drilling operations, and wherein said discontinuity in said surface is a concavity extending into said cutting surface of said layer of superabrasive material.

2. A drilling insert for use on a bit for drilling subterranean formations, comprising:

(A) a substrate having a top surface; and (B) a layer of superabrasive material, having in interface surface, bonded to said top surface of said substrate, and a cutting surface opposite said interface surface, wherein said cutting surface has a non-planar shape and has one or more discontinuity to increase cutting stress on the subterranean formations during drilling operations, and wherein said discontinuity in said cutting surface is a channel cut into said surface of said layer of superabrasive material.

3. A drilling insert for use on a bit for drilling subterranean formations, comprising:

(A) a substrate having a top surface; and (B) a layer of superabrasive material, having in interface surface, bonded to said top surface of said substrate, and a cutting surface opposite said interface surface, wherein said cutting surface has a non-planar shape and has one or more discontinuity to increase cutting stress on the subterranean formations during drilling operations, and wherein said discontinuity in said cutting surface is a groove cut into said surface of said layer of superabrasive material.

* * * * *